United States Patent [19]

Kirchnerova et al.

[11] 4,198,253

[45] Apr. 15, 1980

[54] EXPLOSIVE COMPOSITIONS CONTAINING SULPHONATED GUAR GUM DERIVATIVES

[75] Inventors: Jitka Kirchnerova, Montreal; Errol L. Falconer, Mont Saint-Hilaire, both of Canada

[73] Assignee: Canadian Industries Limited, Montreal, Canada

[21] Appl. No.: 968,560

[22] Filed: Dec. 11, 1978

[30] Foreign Application Priority Data

Jan. 19, 1978 [CA] Canada ..... 295325

[51] Int. Cl.[2] ..... C06B 33/02

[52] U.S. Cl. ..... 149/44; 149/41; 149/43; 149/60; 149/61

[58] Field of Search ..... 149/41, 44, 43, 60, 149/61

[56] References Cited

U.S. PATENT DOCUMENTS 3,919,015 11/1975 Bolza ..... 149/60 X

*Primary Examiner*—Stephen J. Lechert, Jr.

*Attorney, Agent, or Firm*—Donald G. Ballantyne

[57] ABSTRACT

A slurry explosive composition is provided which has improved water resistance and thermal stability and resists segregation. The composition consists of an inorganic oxygen-supplying salt, a liquid carrier or solvent for the salt, a solid or liquid fuel and, as a thickener a sulfonated guar gum derivative.

6 Claims, No Drawings

EXPLOSIVE COMPOSITIONS CONTAINING SULPHONATED GUAR GUM DERIVATIVES

This invention relates to water-bearing explosive compositions comprising essentially an inorganic oxygen-supplying salt, a fuel, a thickener and water. In particular, the invention relates to a means whereby the thickening and gelling of such explosive compositions may be substantially improved.

Explosive compositions comprising one or more oxygen-supplying salts such as, for example, ammonium, sodium and calcium nitrates and a fuel together with a fluid solvent, disperser or carrier such as water, are widely known. These compositions are commonly referred to as slurry explosive compositions or, more generally, as slurry explosives.

Slurry explosives of the aforementioned types normally contain as essential ingredients power enhancing materials and fuels such as, for example, finely divided light metal, finely divided carbon and the like. In some cases, it is advantageous to include in the compositions a self-explosive fuel ingredient such as particulate TNT, PETN, or smokeless powder or a water-soluble organic nitrate such as ethylene glycol mononitrate or hydrocarbon ammonium nitrates to further improve the sensitivity and/or strength, thereby insuring detonation and propagation. A wide range of such compositions are now known to the art.

Of most important commercial interest are the water-bearing explosive slurry compositions wherein an aqueous solution of oxidizer salt comprises the greater proportion of the fluid carrier or disperser for the solid ingredients of the explosive mixture. While these water-bearing slurry explosives possess many advantages such as economy in manufacture and use and reduced hazard, they may at the same time be susceptible to the segregation of the solid and liquid ingredients both when packaged in containers and when placed directly into the borehole. These slurry explosives are also subject to dilution by water when present in the borehole, which water may leach out water-soluble ingredients and result in possible detonation failure. To overcome the problems of water attack and penetration, manufacturers of water-bearing explosive slurries have employed a wide range of thickening agents as essential components of the slurries for the purpose of cohering together the ingredients in the form of thickened, and/or gelled, non-segregating mixtures which will resist deterioration caused especially by excess water and so overcome the difficulties mentioned heretofore.

Many thickening or gelling agents are known which have been employed with varying degrees of success, either alone or in combination, in water-bearing explosive slurries. Amongst these may be mentioned galactomannan polysaccharide guar gums, pre-gelatinized starches, hydroxyethylcellulose, carboxymethylcellulose, tamarind seed flour, psyllium flour and hydrophilic vinyl polymers, such as, for example, polyacrylamide. The most widely used of these thickening agents have been the galactomannans, particularly guar gums. While the uncrosslinked galactomannans have enabled the production of slurry explosives of improved homogeneity and resistance to water penetration, these have not been completely successful per se in producing a slurry explosive of optimum physical characteristics for a wide range of physical conditions. Relatively large percentages of thickener are required to prevent segregation and the resulting compositions may be unduly tacky or adherent to contacting surfaces. Water resistance is also less than complete. When a cross-linked galactomannan is employed as a thickener, water resistance is improved, adhesiveness is reduced and segregation is more conveniently prevented but at the same time the resultant slurry may frequently range from one which is overly stiff in consistency and cannot easily be poured into boreholes to one which is still unduly soft and tacky. Because of either the high resistance to flow or the tackiness of slurries made with the crosslinked galactomannans, great difficulty is often experiences in delivery of the product through pipeline hoses by means of pumps. Thus, care must be exercised to use appropriate types and amounts of guar gum and crosslinking agent. An important inconvenience in using guar gums as thickeners is their relatively low thermal stability, whether they are in a crosslinked or an uncrosslinked form. Additionally, stability at temperatures up to 65° C. or higher is often required because of manufacturing processes employed or because of high temperature storage or use conditions. It has been observed that guar-thickened aqueous explosives slurries containing calcium nitrate as an ingredient present particular thickening problems caused by the ability of calcium ions in solution to associate with the guar to form crosslinks and retard hydration of the guar. Even when moderate concentrations of calcium nitrate are employed the resulting mixture becomes highly viscous and tacky and resists mixing and pumping. It has also been observed that guar-thickened calcium nitrate-containing slurries tend to degrade more quickly at elevated temperatures than those devoid of calcium nitrate.

It has now been found that a water-bearing explosive slurry composition may be provided which will not segregate over long periods of high temperature storage, is highly water resistant and yet may be poured or pumped with little or no difficulty. In particular, the liquor used in the preparation of such explosive slurries can be prethickened and stored at relatively high temperatures for long periods.

It is therefore the primary object of this invention to provide a slurry explosive composition which combines the features of water resistance, thermal stability, and non-segregation. Additional objects will appear hereinafter.

The improved explosive composition of this invention comprises essentially at least one inorganic oxygen-supplying salt, a fuel, water and a thickener, the thickener comprising a sulfonated guar gum derivative.

Guar gum is classified in chemical terms as a galactomannan, or high molecular weight carbohydrate polymer or polysaccharide made up of mannose and galactose units linked together in the manner shown in the structural formula below:

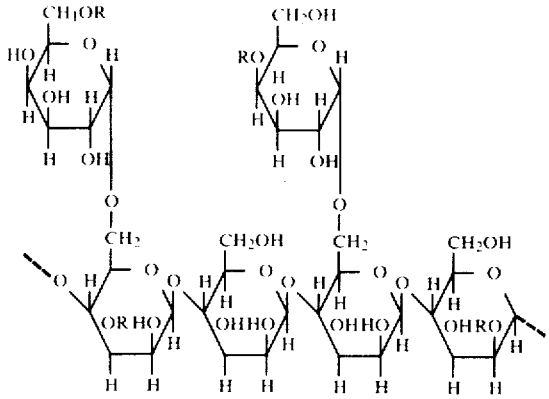

As can be seen the molecule is essentially a straight chain mannan branched at intervals with single-membered galactose units on alternate mannose units. The mannose units are linked by means of beta(1-4)glycosidic linkages while the galactose connection is by means of an alpha(1-6) linkage. With standard or unmodified guar the functional group R is hydrogen. With the modified guar of the present invention, the functional group R contains a sulfonate group which is preferably a 2-hydroxypropyl sulfonate group, which substitution is accomplished by sulfonation of standard guar using an alkali e.g. sodium or ammonium salt of 3 halo-2-hydroxypropane sulfonic acid as a reactant. The degree of substitution in the sulfonated guar derivative is preferably between 0.06 and 0.07 and, due to its ionic character, this guar has a higher solubility in polar liquids than standard guar.

Preferred slurry blasting slurry explosive compositions of this invention contain from 30% to 90% by weight of at least one inorganic oxygen-supplying salt, from 5% to 40% by weight of water, or other solvent, disperser or carrier, from 0.1% to 2.0% by weight of sulfonated guar gum derivative alone or in combination with other type(s) of guar and from 5% to 40% by weight of fuel or fuel/sensitizer.

A preferred solvent or carrier for the oxidizing salt is water. However, up to half of the water may be replaced by organic solvents such as formamide, dimethyl sulfoxide and the lower glycols and alcohols. These solvents are polar liquids, readily miscible with water in all proportions and are effective solvents for ammonium nitrate and other inorganic salts and tend to function as fluidizing agents in the mixture.

The fuels employed in the composition of the invention may be, for example, non-explosive carbonaceous material such as finely divided carbon or sulfur, energetic metals such as aluminium or aluminium alloys, metalloids such as silicon, particulate self-explosive fuels, or mixtures of these, and oleaginous hydrocarbons.

Where employed as fuel, the aluminium or aluminium alloy or other energetic metal or metalloid such as silicon, must be in finely divided form and may most suitably range from a fine dust to a form not coarser than that which will pass through a size 6 Tyler mesh screen. For example, relatively inexpensive air-atomized powder, shredded foil or granules made from reclaimed scrap are suitable types of aluminium. Where silicon is employed, the fine powder form is used.

Useful particulate self-explosives which may be used as sensitizer/fuel in the explosive composition include, for example, trinitrotoluene (TNT), pentaerythritol tetranitrate (PETN), cyclotrimethylenetrinitramine (RDX), composition B (mixture of TNT and RDX), pentolite (mixture of PETN and TNT), smokeless powder, nitrocellulose, nitrostarch and mixtures of these. Useful soluble sensitizer/fuels which may be employed include, for example, the lower alkylamine nitrates such as methylamine nitrate and ethylamine nitrate, the alkanolamine nitrates such as ethanolamine nitrate and propanolamine nitrate, nitrogen based salts such as ethylenediamine dinitrate, urea nitrate and aniline nitrate and the liquid hydroxyalkyl nitrates such as ethylene glycol mononitrate or propyleneglycol mononitrate.

Suitable carbonaceous fuels include, for example, finely divided coal or carbon, vegetable products such as woodmeal, sugar, ground nut husks, and the like, hydrocarbon oils and similar oleaginous material, urea and mixtures of these.

Suitable oxygen-supplying salts include the nitrates of ammonium, sodium, potassium and calcium or mixtures of these.

The explosive composition may be prepared by processes well known in the art employing simple mixing procedures. In general, the sulfonated guar gum derivative is hydrated in a mixture of the nitrate salts and water with pH adjustment preferably into the range of 3.1 to 5.5. A mix procedure is adopted which allows good hydration of the guar component and mixing is usefully carried out at an elevated temperature to reduce the time of hydration. To this precursor thickened liquor is added the fuel/sensitizer ingredient together with additional particulate salt and, optionally, further thickener and crosslinker to provide a finished explosive slurry of desired composition.

The degree of thickening or gelling and hence the viscosity and fluidity of the slurry explosive composition of the invention is dependent on the quantity of the sulfonated guar gum employed and on the quantity and type of cross-linking agent used. It will be obvious that variations are possible which will permit the manufacture of explosive slurries having a wide range of gel characteristics. The preferred slurry composition however, is one which is easily pourable or pumpable yet which retains all the water resistant and antisegregation properties of a thick or dense gel. Slurry explosives of high viscosity may be obtained through the use of a larger percentage by weight of thickener.

The present invention is further elaborated and may be further understood by reference to the following Examples and Tables wherein, unless otherwise specifically indicated, all quantities are based on parts by weight of the total composition. Any of the liquor compositions disclosed in Examples 1-5 can be converted to a finished explosive slurry by the addition thereto of appropriate amounts of solid oxidizer salt and solid or liquid fuel, part of which fuel can be a self-explosive material.

EXAMPLE 1

A typical guar-thickened precursor slurry explosive aqueous liquor containing oxidizing salts was prepared as follows: 1.2 or 1 parts of various types of guar was slurried with 2.4 or 2 parts of ethylene glycol and then mixed well with 100 parts of a hot (70° C.) solution containing 50 parts of ammonium nitrate, 24 parts of calcium nitrate, 26 parts of water and buffered to pH 4.5 with 0.2 part of buffer solution containing 10 parts of acetic acid, 10 parts of sodium acetate and 80 parts of water. The thickened liquor mixture was kept at 70° C. for period of time and its viscosity was measured at different intervals by using a Brookfield viscometer at 20 rpm and spindle number 6. The results given in Table I below show the thickening effect of different guars expressed as viscosities and its variation with time. The results demonstrate clearly the unexpectedly high heat resistance of compositions containing sulfonated guar derivative when compared with the heat stability of compositions containing unmodified guar or hydroxypropylated guar.

TABLE I

Effect of Storate Time at 70° C. on Viscosity of AN/CN/$H_2O$ Liquor Thickened with Different Guars Brookfield Viscosity Readings at 20 rpm and Spindle No. 6

| Guar | Storage Time 10′ | 30′ | 60′ | 1 day | 4 days | 10 days |
|---|---|---|---|---|---|---|
| Unmodified* | 55 | 62 | 64 | 47 | 2 | 0.2 |
| Unmodified** | 28 | 33 | 31 | 12 | 1.1 | 0 |
| Sulfonated* | 27 | 36 | 43 | 47 | 32 | 30 |
| Sulfonated* | 13.5 | 25 | 29.5 | 13 | 9 | |
| | 19.5 | | | | | |
| Hydroxypropylated** | 17 | 23 | 24 | 18 | 5 | 1 |
| Thermally Stabilised** | 13.5 | 27.5 | 28 | 6 | 0 | — |

*1.2 parts
**1 part

EXAMPLE 2

Two liquor solutions each containing 50 parts of ammonium nitrate, 30 parts of fertilizer grade calcium nitrate and 20 parts of water were thickened at 75° C. by one part of (a) unmodified guar and (b) sulfonated guar derivative, respectively. The liquor solutions were stored at 75° C. for more than 3 weeks. The variation of viscosities with time of the two liquor is shown in Table II.

TABLE II

Viscosity Change on Storage at 75° C. of Thickened AN/CN/Water Liquors
Brookfield Viscosity Readings at 20 rpm and Spindle No. 6

| Guar | Time 10 min. | 40 min. | 60 min. | 3 days | 6 days | 2 wks. | 3 wks. |
|---|---|---|---|---|---|---|---|
| Unmodified | 4.6 | 47.9 | 54.8 | 34.2 | 27 | 25 | 15 |
| Sulfonated | 1.6 | 37.5 | 41.6 | 55.0 | 52 | 52 | 38 |

EXAMPLE 3

This example illustrates the stability of three different types of guar in liquors composed of ammonium nitrate, sodium nitrate and water. Two liquor compositions were used. Composition I, comprised 60 parts of ammonium nitrate, 20 parts of sodium nitrate, 20 parts of water and 0.2 part of pH=4.5 buffer. Composition II comprised 63 parts of ammonium nitrate, 21 parts of sodium nitrate, 16 parts of water and 0.3 part of pH=4.5 buffer. Each composition was thickened as described in Example 1 at 67° C. and stored at the same temperature. The results given in Table III show clearly improved thermal stability of thickened liquor when sulfonated guar is used as a thickener.

TABLE III

Viscosity Variation Upon the Storage at 67° C. of Two AN/SN/Water Compositions Thickened with Guar
Brookfield Viscosity Readings at 20 rpm and Spindle No. 6

| Guar (1.2 parts) | | Time 10 min. | 30 min. | 60 min. | 1 day | 2 days | 5 days | 9 days | 15 days |
|---|---|---|---|---|---|---|---|---|---|
| Unmodified | Composition I | 21.5 | 25.0 | 26.1 | 27.5 | 21.1 | 12.9 | 8.3 | 4 |
| Carboxymethyl hydroxy-propylated | Composition I | 21.5 | 25.0 | 27.7 | 28.7 | 24.5 | 11.8 | 8.0 | 6 |
| Sulfonated | Composition I | 19.1 | 27 | 35.6 | 31.5 | 29.0 | 22.5 | 17.0 | 10 |
| Unmodified | Composition II | 30.0 | 33.8 | 37.4 | 39.5 | 33 | 24 | 13 | 7 |
| Carboxymethyl hydroxy-propylated | Composition II | 24.3 | 33.2 | 34.9 | 32.8 | 29.5 | 14.1 | 9 | 8 |
| Sulfonated | Composition II | 21.8 | 26.7 | 33.6 | 42.5 | 41.1 | 32.6 | 19 | 16.5 |

EXAMPLE 4

A precursor slurry liquor was prepared comprising 75 parts of ammonium nitrate and 25 parts of water. Separate samples of the liquors were thickened using one part of either unmodified guar of sulfonated guar at 70° C. Deviation of viscosity with time of the two thickened liquors kept at 70° C. is shown in Table IV.

TABLE IV

Viscosity Variation UPon Storage at 75° C. of AN Liquor Thickened with Guar
Brookfield Viscosity Readings at 20 rpm and Spindle No. 6

| Guar | Time 10 min. | 30 min. | 60 min. | 1 day | 6 days | 2 wks. | 3 wks. |
|---|---|---|---|---|---|---|---|
| Unmodified | 13.5 | 14.5 | 16 | 13.5 | 6.5 | 2.0 | 0 |
| Sulfonated | 10 | 12.2 | 14.3 | 15.5 | 12 | 7.5 | 5 |

The results presented in the foregoing Examples and Tables demonstrate the improved stability of different oxidizer salt compositions thickened with sulfonated guar derivative. This thermal stability is particularly enhanced in solutions containing calcium nitrate, as shown in Examples 1 and 2.

The following example demonstrates that liquor thickened with the sulfonated guar derivative and kept at 70° C. for several days can be effectively crosslinked to give a strong and stable gel.

EXAMPLE 5

A precursor slurry liquor was prepared comprising 48.1 parts of ammonium nitrate, 30.8 parts of fertilizer grade calcium nitrate, 21 parts of water and 0.2 part of pH=4.5 buffer, and was thickened at 70° C. with 1 part of various guars (or guar mixtures) pre-blended with 2 parts of ethylene glycol. The thickened liquor was stored at 70° C. for 24 days, its viscosity being measured at intervals by using Brookfield viscometer with Spindle No. 6 at 20 rpm. At the end of storage, the samples were crosslinked by adding 0.15 part of crosslinking solution comprising 20% by weight of sodium dischromate as a main component. The results are shown in Table V.

TABLE V

Viscosity change on storage at 70° C. of AN/CN/Water Liquor Thickened with Different Guars and Stability of Gel Resulting from Crosslinking of the Stored Liquor Brookfield Viscosity Readings at 20 rpm and Spindle No. 6

| | Time | | | | | gel |
|---|---|---|---|---|---|---|
| Guar (1 part) | 10 min. | 60 min. | 1 day | 13 days | 24 days | stability at 70° C. |
| Unmodified | 38.5 | 43.9 | 32.5 | 15.5 | 3 | 1 day |
| 1:1 mixture of unmodified and Hydroxypropylated | 31.5 | 38.8 | 30.5 | 15 | 3 | 1 day |
| Hydroxypropylated | 26.5 | 35 | 28 | 17 | 4 | 2 days |
| Carboxymethylhydroxypropylated | 28.5 | 40.5 | 30 | 17 | 5 | 5 days* |
| Sulfonated | 26.5 | 42.5 | 42 | 28.5 | 16 | 8 days* |

*refers to the gel which is still intact but has softened during storage

EXAMPLE VI

Three aqueous slurry explosive compositions were prepared by first preparing three hot liquor mixtures (about 70° C.) comprising water, oxygen-supplying salts and thiourea. The pH of the liquors were adjusted to 4.5 and then thickened by the addition thereto of guar or guar mixture dispersed in glycol. Into each of the prethickened liquors, additional fuel, salts, gassing agent and crosslinker were blended and the compositions were packaged into 7.6 cm diameter plastic film cartridges. After storage for one week at 35° C. the cartridges were initiated unconfined at 25° C. by means of a 20 gram primer of a 1:1 mixture of TNT and PETN. The compositions of the explosives and the results of detonations are shown in Table VI.

TABLE VI

Characteristics of Thickened Blasting Agents

| | Composition (percent by weight) | | |
|---|---|---|---|
| Ingredients | A | B - A | C - A |
| Solution: | | | |
| Water | 9.00 | | |
| AN | 41.67 | | |
| CN (technical grade) | 13.08 | | |
| Thiourea | 0.13 | | |
| Thickening agent | 0.35[a] | [b] | [c] |
| Ethylene glycol | 0.70 | | |
| Lignosol TSD | 0.35 | | |
| Fuel oil | 3.60 | | |
| Dry-AN-prilled | 29.52 | | |
| Fuel oil - dispersed on AN prills | 1.60 | | |
| Gassing agent[d] | 0.60 | | |
| Crosslinking agent[e] | 0.05 | | |
| Properties: | | | |
| Density (g/ml) | 0.95 g/ml | 0.93 | 0.95 |
| VOD at 25° C., in 7.6 cm diameter (unconfined plastic cartridges) | 2.54 | 2.89 | 2.65 |

[a]unmodified guar
[b]1:1 mixture of unmodified guar and sulfonated guar
[c]sulfonated guar
[d]25% solution of $NaNO_2$
[e]technical potassium pyroantimonate

What we claim is:

1. A slurry explosive composition comprising at least one inorganic oxygen-supplying salt, a solvent or carrier for the inorganic oxygen-supplying salt, a solid or liquid fuel and a thickener, said thickener comprising a sulfonated guar gum derivative.

2. A slurry explosive composition comprising from 30% to 90% by weight of an inorganic oxygen-supplying salt, from 5% to 40% by weight of a liquid solvent, disperser or carrier, from 5% to 40% by weight of a fuel or fuel/sensitizer and from 0.1% to 2.0% by weight of a sulfonated guar gum derivative thickening agent.

3. An explosive composition as claimed in claim 1 wherein the inorganic oxygen-supplying salt is selected from the group consisting of nitrates and ammonium, sodium, potassium and calcium and mixtures thereof.

4. An explosive composition as claimed in claim 2 wherein the fuel or fuel/sensitizer is selected from the group consisting of finely divided aluminum or aluminum alloy, silicon, finely divided carbonaceous material, oleaginous hydrocarbons, particulate insoluble self-explosives, soluble self-explosives and mixtures thereof.

5. An explosive composition as claimed in claim 1 wherein the solvent or carrier is water.

6. An explosive composition as claimed in claim 5 wherein up to half of the water is replaced by a polar liquid selected from the group consisting of formamide, dimethy sulfoxide, the lower glycols, the lower alcohols and mixtures of these.

* * * * *